US005568740A

United States Patent [19]

Lin

[11] Patent Number: 5,568,740

[45] Date of Patent: Oct. 29, 1996

[54] STEEL WIRE ROPE LOCK

[76] Inventor: Yung-Ta Lin, No. 67, Lane 77, Sec. 1, An Ho Road, Tainan, Taiwan

[21] Appl. No.: 518,294

[22] Filed: Aug. 15, 1995

[51] Int. Cl.[6] ..... E05B 67/06

[52] U.S. Cl. ..... 70/49; 70/18

[58] Field of Search ..... 70/18, 19, 30, 70/49, 38 A, 38 B, 38 C, 52; 411/518

[56] References Cited

U.S. PATENT DOCUMENTS

| | | | |
|---|---|---|---|
| 557,522 | 3/1896 | Blake | 70/49 |
| 2,595,787 | 5/1952 | Heimann | 411/518 |
| 3,765,196 | 10/1973 | Balicki | 70/49 |
| 4,075,878 | 2/1978 | Best | 70/49 |
| 4,183,280 | 1/1980 | Hashimoto | 411/518 |
| 5,065,603 | 11/1991 | Kloke | 70/49 |
| 5,170,650 | 12/1992 | Kortenbrede | 70/49 |
| 5,406,812 | 4/1995 | Jaw | 70/38 A |

FOREIGN PATENT DOCUMENTS

| | | | |
|---|---|---|---|
| 895516 | 1/1945 | France | 70/18 |
| 1005254 | 4/1952 | France | 70/49 |
| 962322 | 4/1957 | Germany | 70/49 |
| 2224071 | 4/1990 | United Kingdom | 70/18 |

*Primary Examiner*—Darnell M. Boucher

*Attorney, Agent, or Firm*—Morton J. Rosenberg; David I. Klein

[57] ABSTRACT

A steel wire rope lock has a lock housing, a lock fixed in a first end portion of the housing, and a steel wire rope having a first end fixed with a first end connecter and fitted around in a center hole of an annular member, and then connected with a second end of the housing. A second, end of the rope is fixed with a second connecter shaped tubular and having an annular groove near a bottom end, able to be inserted in a lateral hole of the housing to be kept immovable, i.e. locked by a deadbolt with a deep groove to fit around the annular groove of the second connecter if the lock is locked by a key.

1 Claim, 4 Drawing Sheets

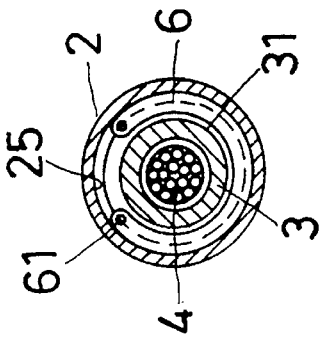
FIG.3
FIG.2
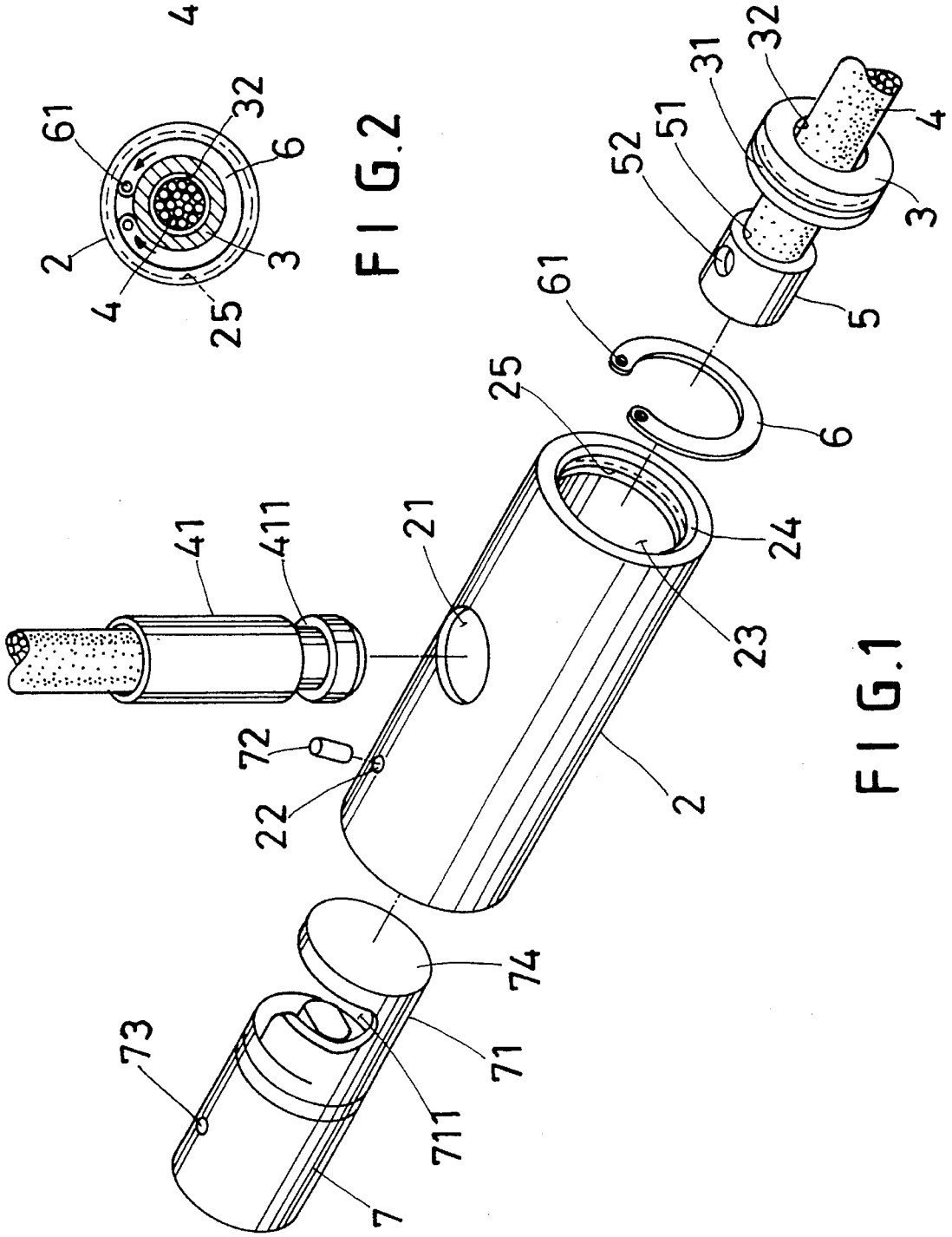
FIG.1

STEEL WIRE ROPE LOCK

BACKGROUND OF THE INVENTION

This invention concerns a steel wire lope lock, particularly having a simple structure easy for processing, and able to make use of a tube available in market as a lock housing.

A known conventional steel wire rope lock shown in FIG. 5 consists of a lock housing 11, a lock 12 fixed therein, a steel wire rope 15 having one end fixed firmly with one end of the housing 11 and the other end fixed with a connecter 14 formed of an annular groove 142 and a bottom end 141. Then the steel wire rope 15 is wound around an object to be locked, with the connecter 14 fitted in a hole 111 of the housing 11 and kept immovable by a deadbolt of the lock 12 with a key operated.

However, the above-mentioned conventional steel wire rope lock seems very troublesome in manufacturing. As shown in FIG. 6, and the housing 11 is made of solid steel material, firstly bored with a hole 111 in an intermediate portion for receiving the connecter 14, and secondly a center hole 112 for placing the lock 12 therein, a small round hole 115 for a pin 121 to fit in for securing the lock 12, a center hole 114 communicating with the center hole 112 for a deadbolt 122 of the lock 12 to extend therein. In addition, the other end of the housing has to be bored with a center hole 115 for receiving the other end of the steel wire rope 13, but the wall of the housing 11 is thick, hard to secure the steel wire rope 13, so a partial wall has to be cut to become a thinner wall 116 and a recess 117 on the wall 116 is to be pressed to secure the steel wire rope 13.

The conventional steel wire rope lock needs mechanical process for boring various holes by operating lathes and for punching a recess by a press, involving complicated processes, taking much time and work.

SUMMARY OF THE INVENTION

This invention has been devised to offer a kind of steel wire rope of a simpler structure than the conventional one mentioned above.

A steel wire rope lock in the present invention includes a lock housing made of a tube material available in market, a lock unit fixed in one end portion of the housing, a steel wire rope having one end connected movably with the other end of the housing via an end (first) connecter and an annular member and the other end fixed with another (second) connecter. The second connecter is to be fitted in a lateral hole of the housing and able to be kept immovable, i.e. locked by a deadbolt having a deep groove moved up to engage the annular groove of the second connecter. Then the steel wire rope wound around an object cannot be taken off unless the lock is unlocked with a key.

BRIEF DESCRIPTION OF DRAWINGS

The invention will be better understood by reference to the accompanying drawings wherein:

FIG. 1 is an exploded perspective view of a steel wire rope lock in the present invention;

FIG. 2 is a cross-sectional view of a steel wire rope lock in the present invention, showing a connecter being inserted in its position;

FIG. 3 is a cross-sectional view of the connecter combined with a lock housing in the steel wire rope lock in the present invention;

DESCRIPTION OF THE PREFERRED EMBODIMENTS

Figure 4:
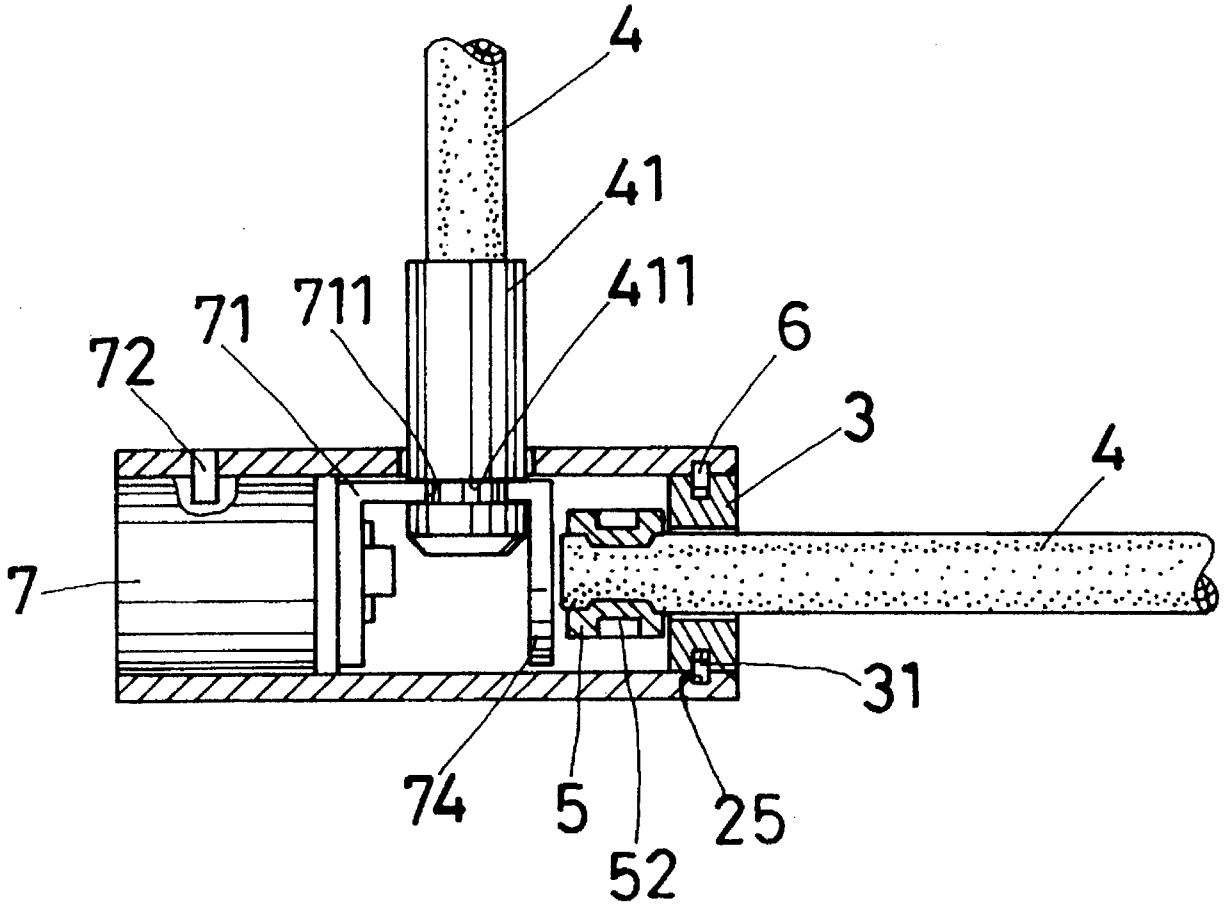
FIG. 4 is a cross-sectional view of the steel wire rope lock in the present invention, showing it being in a locked condition.
Figure 5:
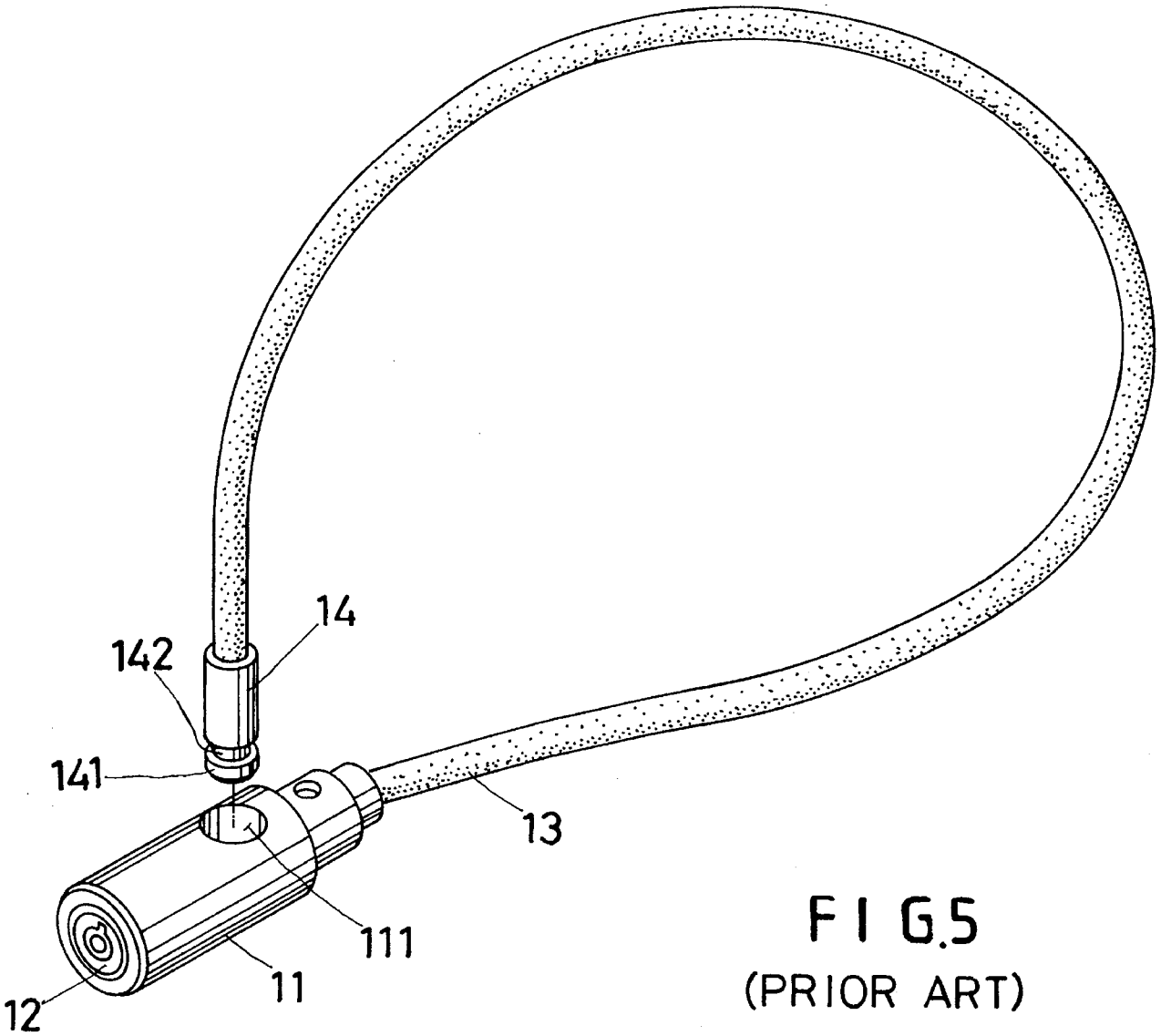
FIG.5 (PRIOR ART)
FIG. 5 is a perspective view of a known conventional steel wire rope lock; and, FIG. 6 is a cross-sectional view of the known conventional steel wire rope lock in FIG. 5.
Figure 6:
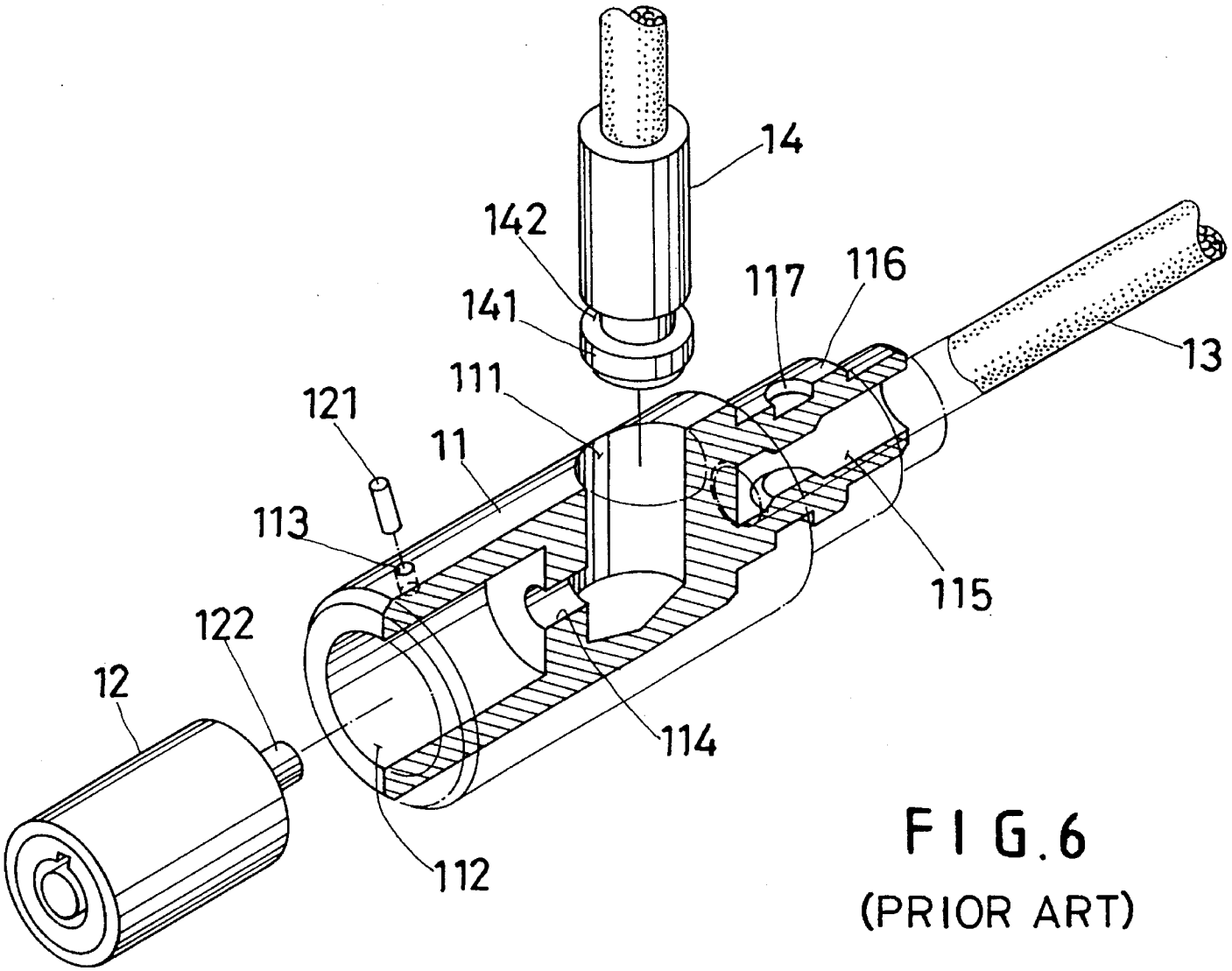
FIG. 6 (PRIOR ART)

A preferred embodiment of a steel wire rope lock in the present invention, as shown in FIG. 1, consists of a lock housing 2, an annular member 3, a steel wire rope 4, a first end connecter connecter 5, a second end connecter 41, a resilient C-shaped ring 6 and a lock 7 combined together.

The lock housing 2 is made of a tube with a thick wall, having a lateral hole 21 for the second end connecter 41, and a pin hole 22 for fixing the lock 7 in a first end portion, a mouth 23 in a second end, a guide edge 24 provided in the mouth 23 and an annular groove 25 provided to abut inward to the guide edge 24.

The annular member 3 has an annular groove 31 for the C-shaped ring 6 to fit therein and an center hole 32 for the steel wire rope 4 to fit through.

The first end connecter 5 is shaped tubular, having a center hole 51 for fixing tightly a first end of the steel wire rope 4 therein, and a recess 52 formed by forcefully pressing down so as to hold the first end of the steel wire rope 4 tightly and immovable.

The resilient C-shaped ring 6 has two holes 61, 61 at two ends, fixed around an annular groove 25 of the lock housing 2 and the annular groove 31 of the annular member 3 by compressing after the first connecter 3 and the annular member 3 are combined in the mouth 23 of the lock housing 2.

The lock 7 has a deadbolt 71 extending rearward and shaped as tubular to fit in the center through hole of the lock housing 2, having a deep groove 711 in an intermediate portion and a bottom straight vertical wall 74. The lock 7 has a lateral small hole 73 for a pin 72 to fit therein to secure the lock 7 with the lock housing 2.

The second end connecter 41 has a tubular shape and an annular groove 411 in an outer end for the deep groove 711 of the deadbolt 71 of the lock 7 to fit around in order to hold the second end connecter 41 immovable, i.e. locking this lock.

In assembling, referring to FIG. 1, the lock 7 is inserted in a second end portion of the lock housing 2 and secured with the pin 72 fixed in the pin hole 22 of the housing 2 and also the pin hole 73 of the lock 7. Next, as shown in FIG. 2, the first end connecter 5 clamping the first end of the steel wire rope 4 and the annular member 5 are inserted in the mouth 23 of the lock housing 2, and then the C-shaped ring 6 pinched and compressed with a tool fitted in the two holes 61 and then forced to engage with the annular groove 31 of the annular member 3, and continually forced to slide inward along the guide edge 24 and engage with the annular groove 25 of the lock housing 2, positioning the annular member 3 and the first end connecter 5 in the lock housing 2 as shown in FIG. 3.

When the lock 7 is in an unlocked position, the deadbolt 71 is located with the deep groove 711 at a low position, and when lock unit 7 is in a locked position, by rotating a key in the lock 7, the deadbolt 71 is turned 180, with the deep groove 711 move up to engage the annular groove 411 of the second connecter 41 of the steel wire rope 4 so that the second connecter 41 is held immovable, i.e. this lock is locked.

As can be understood from the above description, this lock has merits as follows:

1. It is simplified better than the conventional ones, constructed with fewer holes for mechanical processing in manufacturing.

2. The lock housing can be made of a common steel tube availabe in market needing no complicated mechanical processing, reducing cost in a great degree.

3. One end of the steel wire rope is movably connected with the lock housing so that locking this lock is easier than the conventional known one which has one end of the steel wire rope is firmly fixed with the housing.

While the preferred embodiment of the invention has been described above, it will be recognized and understood that various modifications may be made therein and the appended claim is intended to cover all such modifications which may fall within the spirit and scope of the invention.

What is claimed is:

1. A steel wire rope lock comprising:

a tubular housing having a bore extending therethrough, said tubular housing being defined by a longitudinally extended cylindrical wall surrounding said bore having a predetermined diameter extending between first and second ends of said tubular housing, said cylindrical wall having an inner surface with a first annular groove formed therein adjacent said first end of said tubular housing, said cylindrical wall having a pair of spaced openings formed in open communication with said bore;

a lock disposed in said bore adjacent said second end of said tubular housing and having an aperture formed therein and disposed in aligned relationship with a first of said pair of openings formed in said cylindrical wall, said lock being secured within said bore by a pin member passing through said first opening and said aperture, said lock including an arcuate dead bolt member having a groove formed in a peripheral portion thereof, said peripheral groove being disposed in aligned relationship with a second of said pair of openings formed in said cylindrical wall;

a steel wire rope having opposing first and second ends, said second end of said steel wire rope having a connector coupled thereto and insertable into said bore through said second opening in said cylindrical wall, said connector having a second annular groove formed therein and being lockingly engageable by said dead bolt member within said peripheral groove; and, means for securing said first end of said steel wire rope to said tubular housing, said securing means including an annular member having a centrally disposed through opening of a first diameter for passage of said first end of said steel wire rope therethrough into said bore and a third annular groove formed in a perimeter portion thereof, said annular member being disposed in said bore adjacent said first end of said tubular housing with said third annular groove being aligned with said first annular grove, a resilient c-shaped ring disposed within said third annular groove and extending into said first annular groove for securement of said annular member to said tubular housing, and a connecting member crimped to said first end of said steel wire rope, said connecting member having a second diameter, said second diameter being greater than said first diameter for maintaining said first end of said steel wire rope within said bore.

* * * * *